United States Patent [19]

Kiyosawa

[11] Patent Number: 5,024,006

[45] Date of Patent: Jun. 18, 1991

[54] ATHLETIC SHOE

[75] Inventor: Junichi Kiyosawa, Kobe, Japan

[73] Assignee: Asics Corporation, Hyogo, Japan

[21] Appl. No.: 427,565

[22] Filed: Oct. 27, 1989

[30] Foreign Application Priority Data

Jan. 26, 1989 [JP] Japan ..... 1-8061[U]

[51] Int. Cl.[5] ..... A43B 23/26

[52] U.S. Cl. ..... 36/83; 36/54

[58] Field of Search ..... 36/50, 54, 58.5, 88, 36/99

[56] References Cited

U.S. PATENT DOCUMENTS

| | | | |
|---|---|---|---|
| 1,606,797 | 11/1926 | Julian | 36/54 |
| 2,139,858 | 12/1938 | Schwartz et al. | 36/54 |
| 3,182,366 | 5/1965 | Teufel | 36/50 X |
| 3,574,958 | 6/1971 | Martuch . | |
| 4,372,060 | 2/1983 | Adamik | 36/54 |
| 4,534,123 | 8/1985 | Salomon et al. | 36/99 |
| 4,547,981 | 9/1985 | Thais et al. . | |
| 4,550,511 | 11/1985 | Gamm | 36/50 |

*Primary Examiner*—Daniel P. Stodola
*Assistant Examiner*—John P. Darling
*Attorney, Agent, or Firm*—Nixon & Vanderhye

[57] ABSTRACT

An athletic shoe which has a sole, an upper body disposed on the sole and having a throat opening for insertion of a foot, a vamp having a U-shaped forward opening elongated from the throat opening, and a shoe tongue means disposed to cover the U-shaped forward opening of the vamp. The vamp constitutes a part of the upper body. The shoe tongue means has a first shoe tongue piece and a second shoe tongue piece. The first shoe rongue piece is disposed along one of a pair of opposed side rims defining the U-shaped forward opening formed in the vamp and covers a part of the U-shaped forward opening along the side rim. The second shoe tonge piece is disposed along the other of the pair of opposed side rims defining the U-shaped forward opening formed in the vamp and covers the other part of the U-shaped forward opening.

19 Claims, 7 Drawing Sheets

ATHLETIC SHOE

BACKGROUND OF THE INVENTION

The present invention relates to athletic shoes for various sports.

Conventional athletic shoes have a shoe tongue in order to prevent dust, soil, grains of sand or small stones from getting into the shoe.

Such a shoe tongue is arranged in an upper vamp of an upper body of the athletic shoe. The upper vamp construction of the athletic shoe in accordance with the state of art is disclosed in, for example, U.S. Pat. Nos. 4,255,876 and 4,413,431.

In accordance with the prior art athletic shoe structure, the shoe tongue is secured to the vamp in a portion near a rim at the bottom end of a U-shaped opening elongated from a throat opening of the upper body of the shoe. Therefore, when a person (runner) who is going to put on the shoes inserts his or her foot into the shoe, the shoe tongue is apt to be dragged and urged into the inside of the vamp toward the inner tip thereof along with the instep of the foot, which makes the person feel uncomfortable. Therefore, the conventional athletic shoe is disadvantageous in that it is difficult to the shoe on promptly and to wear it comfortably.

SUMMARY OF THE INVENTION

The present invention was made considering the points mentioned above. It is therefore an object of the present invention to provide an athletic shoe provided with a shoe tongue means which makes it possible to securely and comfortably arrange the shoe tongue to come in contact with the instep of the runner without excessively tightening the instep and thereby obtain a good feeling when the shoes are worn.

Another object of the present invention is to provide an athletic shoe in which the shoe tongue reliably fits the instep of the runner at the center thereof without overly restricting the movement of the foot.

The objects of the present invention can be achieved by an athletic shoe comprising an upper body which is provided with a throat opening for insertion of a person's foot and a U-shaped forward opening elongated from the throat opening, a first shoe tongue piece arranged in one side of the U-shaped forward opening to cover a part thereof and a second shoe tongue piece arranged in the opposed side of the U-shaped forward opening to cover the other part thereof.

An advantage of the according to the present invention athletic shoe structure is that the shoe tongue is prevented from being displaced and/or deformed on the instep of the runner who puts on the shoe, which makes it possible to promptly and comfortably wear the shoe since the shoe tongue for shutting out dust, soil, sand or minute stones is composed of a first shoe tongue piece and a second shoe tongue piece each piece being arranged in one of opposed sides of the U-shaped forward opening formed in a vamp of the upper body of the shoe.

Another advantage of the athletic shoe structure according to the present invention is that the shoe can be reliably applied and fitted to a wide variety of shape, width and height of the instep of the runner putting on the shoe since the first tongue piece and the second tongue piece are independent from each other and can move individually in accordance with the size and shape of the foot of the runner.

Further objects and advantages of the present invention will be apparent from the following description of the preferred embodiments of the invention as illustrated in the accompanying drawings.

DESCRIPTION OF THE PREFERRED EMBODIMENTS

The present invention is further described hereinafter by way of example thereof in comparison to the prior art structure.

Figure 10:
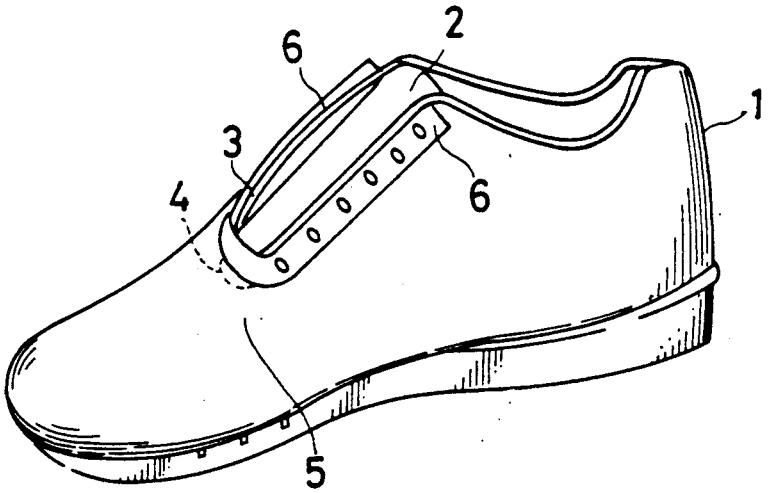
Fig. 10 (PRIOR ART)
FIG. 10 is a perspective view for explaining an athletic shoe in accordance with the prior art.

FIG. 10 illustrates an outer view of a related conventional athletic shoe of the prior art.

As illustrated in the drawing, a conventional athletic shoe 1 comprises a shoe tongue 2 which is disposed to cover a U-shaped forward opening 3 elongated from a throat opening of an upper body of the shoe. The shoe tongue 2 is secured to the shoe, for example, by sewing it to a vamp 5 of the shoe 1 at a front end portion 4 of the U-shaped forward opening 3.

In accordance with the prior art athletic shoe structure mentioned above, since the front end of the shoe tongue 2 is secured to the vamp 5 in a portion near the rim of the front end of the U-shaped forward opening 3, when the runner inserts his or her foot into the shoe, the shoe tongue 2 which comes in contact with the instep of the foot is dragged and urged into the inside of the vamp toward the inner front end thereof along with the instep, which makes the runner feel uncomfortable. Therefore, it is troublesome to rearrange the shoe tongue to a comfortable state at the time the shoe is put on the runner's foot.

On the other hand, in order to obviate the problem of shoe tongue being dragged toward the inside of the vamp, it is proposed to secure the shoe tongue 2 to the vamp 5 at the upper portion 6 of the U-shaped forward opening 3 in addition to the lower front end portion 4 of the shoe tongue.

However, in accordance with the arrangement mentioned above wherein the shoe tongue 2 is secured to the vamp 5 at the upper portion 6 of the U-shaped forward opening 3, its becomes difficult to adapt the shoe to feet having various size and shape, especially when the width and height of the instep of the foot are different, thus restricting the usefulness of the shoes.

In contrast to the prior art athletic shoe structure mentioned above, an embodiment of the present invention has a featured structure as described below.

Figure 1:
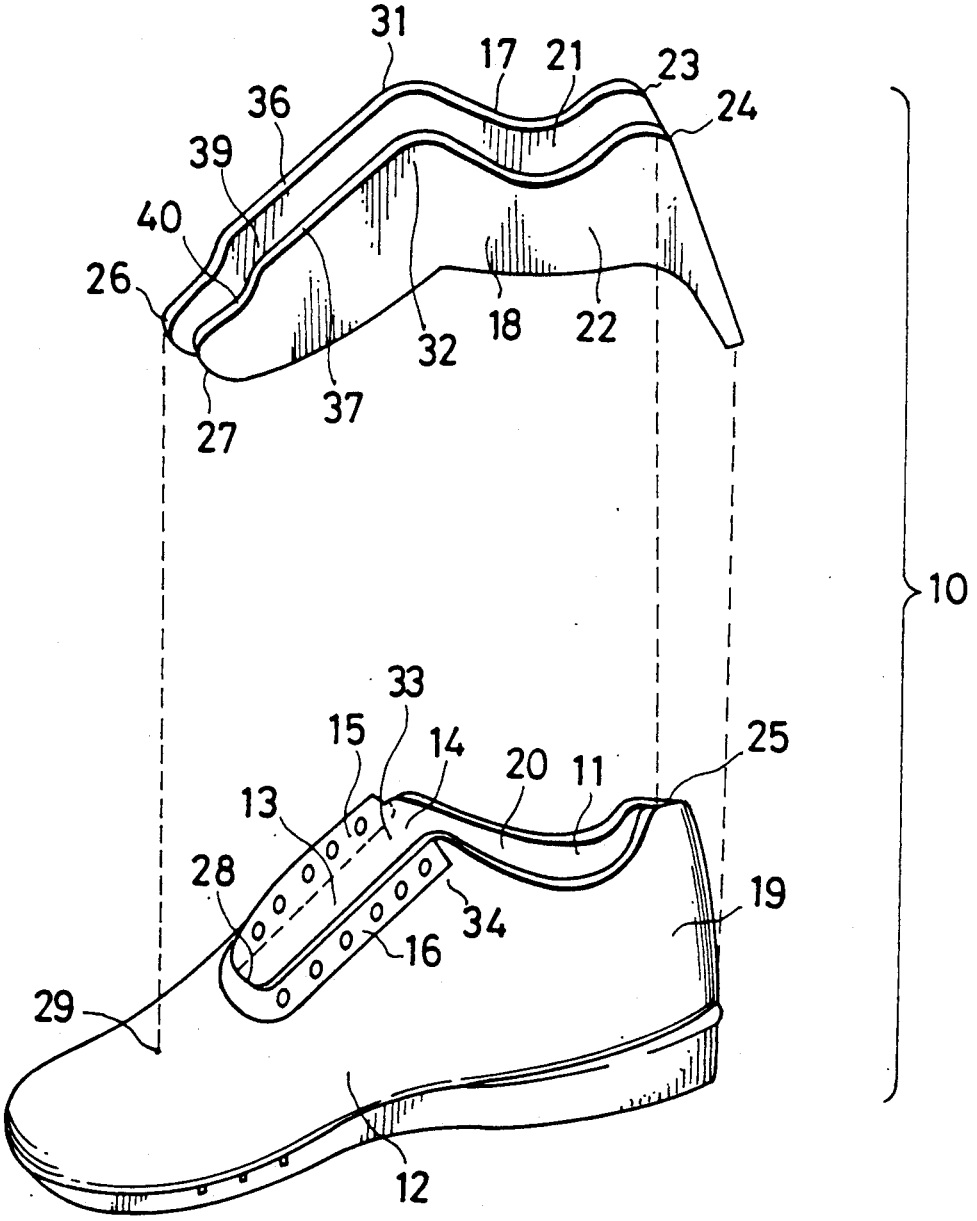
FIG. 1 is a perspective view for explaining a first embodiment of the athletic shoe in accordance with the present invention.
Figure 2:
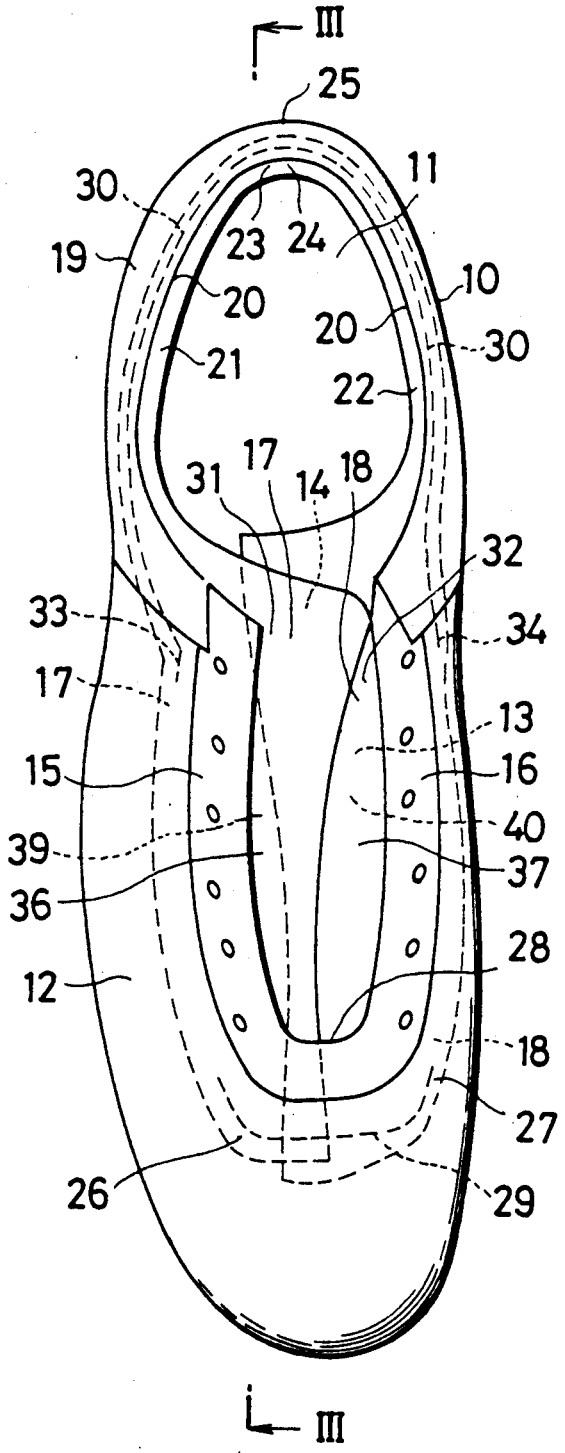
FIG. 2 is a top view of the first embodiment of the present invention.

As illustrated in FIGS. 1 and 2, an athletic shoe 10 in accordance with an embodiment of the present invention comprises a sole and an upper body 19 having a throat opening 11 for insertion of a foot. The upper body 19 comprises a vamp 12 which has a U-shaped forward opening 13 for adjusting the wearing state of the shoe 10. The U-shaped forward opening 13 is elongated from and connected to the throat opening 11 at a boundary portion 14.

A pair of shoe tongue pieces comprising a first tongue piece 17 and a second tongue piece 18 is arranged for preventing dust, soil, sand or minute stones from getting into the shoe 10. FIG. 1 represents a state in which the pair of shoe tongue pieces 17 and 18 is disassembled from the upper body 19 of the shoe 10 whereas FIG. 2 represents a state in which the pair of shoe tongue pieces 17 and 18 is installed within the shoe 10.

As illustrated in FIG. 2, the U-shaped forward opening 13 is defined by a pair of opposed side rims 15 and 16 and a bottom rim 28. The first shoe tongue piece 17 is connected to the side rim 15 for covering a part of the U-shaped forward opening 13 along the side rim 15 whereas the second shoe tongue piece 18 is connected to the other side rim 16 for covering the other part of the U-shaped forward opening 13 along the side rim 16.

The first shoe tongue piece 17 is disposed along an inner edge 20 of the upper body 19 of the shoe 10 around the throat opening 11 in such a manner that it wraps an ankle of the runner who puts on the shoes 10. The first shoe tongue piece 17 comprises a strip-like portion 21 which is disposed around the throat opening 11 and secured to the inner edge 20 of the upper body 19 of the shoe 10 for example by sewing the strip-like portion 21 to and along a portion 30 of the inner edge 20 of the upper body 19 around the throat opening 11.

The second shoe tongue piece 18 is also disposed along the inner edge 20 of the upper body 19 of the shoe 10 around the throat opening 11 in such a manner that it wraps the ankle of the runner. Also, the second shoe tongue piece 18 comprises a strip-like portion 22 which is disposed around the throat opening 11 and secured to the inner edge 20 of the upper body 19 of the shoe 10 for example by sewing the strip-like portion 22 to and along the portion 30 of the inner edge 20 of the upper body 19 around the throat opening 11 in a manner similar to that of the first shoe tongue piece 17.

The first and second shoe tongue pieces 17 and 18 connected together at an end thereof. More precisely, an end 23 of the strip portion 21 of the first shoe tongue piece 17 is secured to an end 24 of the strip portion 22 of the second shoe tongue piece 18. As illustrated in FIG. 2, the strip ends 23 and 24 are connected together at a rear end of a heel portion 25 of the upper body 19 of the shoe 10.

Figure 3:
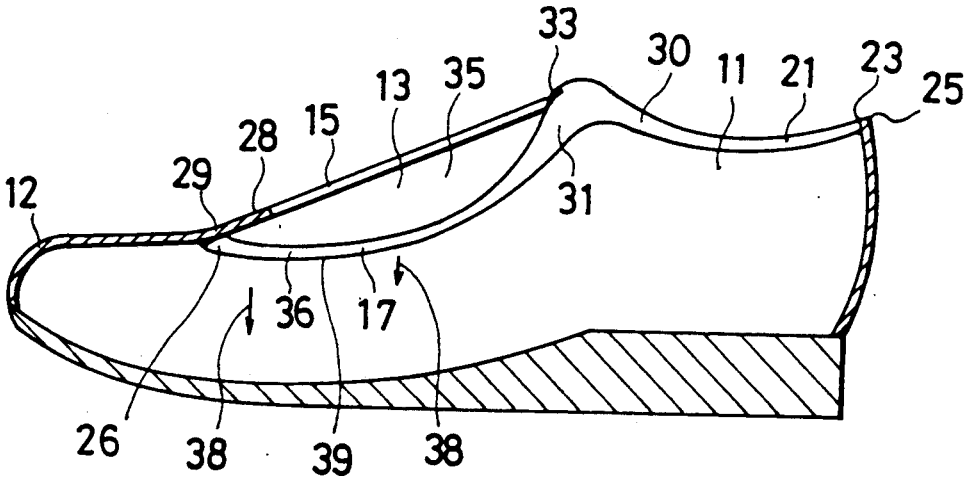
FIG. 3 is a sectional view of the athletic shoe of FIG. 2 taken along a line III—III of FIG. 2.

As illustrated in FIGS. 1 to 3, the first shoe tongue piece 17 comprises an end portion 26 in the opposite side with respect to the strip portion 21. The first shoe tongue piece 17 is secured to the vamp 12 by, for example, sewing the end portion 26 thereof to a portion 29 of the vamp 12 around the bottom rim 28 of the U-shaped forward opening 13 as well as sewing a center portion 31 of the first shoe tongue piece 17 to a portion 33 of the vamp 12 at the position near the boundary portion 14 between the U-shaped forward opening 13 and the throat opening 11. Therefore, an intermediate portion 36 between the end portion 26 and the center portion 31 of the first shoe tongue piece 17 is disconnected from the vamp 12 so that the intermediate portion 36 is freely movable with respect to the vamp 12. Accordingly, when a downward force is applied to the intermediate portion 36 of the shoe tongue piece 17 as illustrated by an arrow 38 in FIG. 3, a space 35 can be formed between the rim 15 of the vamp and the intermediate portion 36 of the shoe tongue piece 17.

Similarly, the second shoe tongue piece 18 comprises an end portion 27 in the opposite side with respect to the strip portion 22. The second shoe tongue piece 18 is secured to the vamp 12 by, for example, sewing the end portion 27 thereof to the portion 29 of the vamp 12 around the bottom rim 28 of the U-shaped forward opening 13 as well as sewing a center portion 32 of the second shoe tongue piece 18 to a portion 34 of the vamp 12 at the position near the boundary portion 14 between the U-shaped forward opening 13 and the throat opening 11. Therefore, an intermediate portion 37 between the end portion 27 and the center portion 32 of the second shoe tongue piece 18 is disconnected from the vamp 12 so that the intermediate portion 37 is freely movable with respect to the vamp 12. Accordingly, when a downward force is applied to the intermediate portion 37 of the second shoe tongue piece 18, a space (not shown) can be formed between the rim 16 of the vamp and the intermediate portion 37 of the second shoe tongue piece 18, as in the case of the first shoe tongue piece 17.

In accordance with the shoe tongue piece arrangement mentioned above in which the space is formed between the vamp and each of the shoe tongue pieces 17 and 18 when a downward force is applied to the shoe tongue piece, the shoe tongue pieces 17 and 18 are movable with respect to the vamp 12 in a state that the lower surfaces 39 and 40 of the shoe tongue pieces 17 and 18 are brought into contact with the instep of the foot at the time the shoes 10 are worn when the shoe lace is tightened to fit the shoe 10 to the foot.

Figure 4:
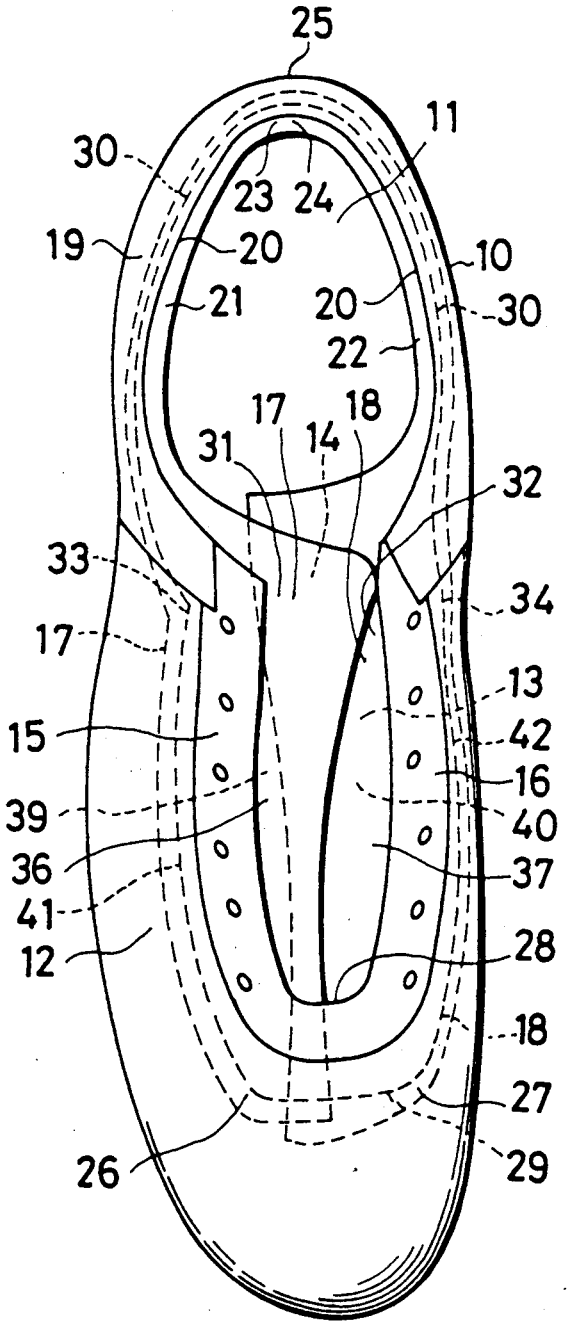
FIG. 4 is a top view of a second embodiment of the athletic shoe in accordance with the present invention.

FIG. 4 illustrates another embodiment of the present invention. In accordance with this embodiment, the intermediate portions 36 and 37 of the first and second shoe tongue pieces 17 and 18 are sewed and secured to side portions 41 and 42 of the vamp 12 along the side rim 15 between the portions 29 and 33 for the first shoe tongue piece 17 and along the side rim 16 between the portions 29 and 34 for the second shoe tongue piece 18 so that the space between the vamp rim and each of the shoe tongue pieces mentioned above is not formed, as illustrated in FIG. 4.

Figure 5:
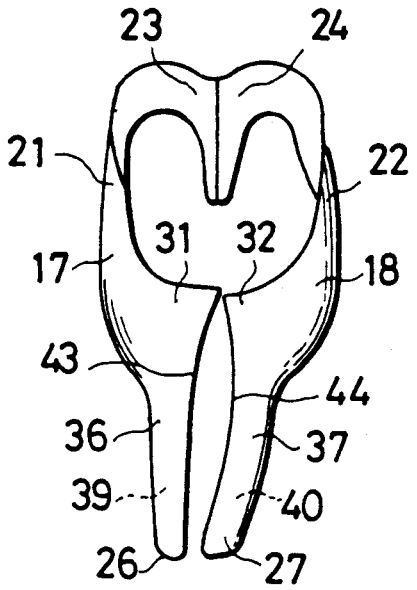
FIG. 5 is an explanatory view of a first shoe tongue piece and a second shoe tongue piece applied to the athletic shoe of the present invention.

FIG. 5 illustrates solely an example of the pair of shoe tongue pieces 17 and 18. Each of the intermediate portions 36 and 37 of the shoe tongue pieces 17 and 18 has a lower contact surface 39 or 40 which comes in contact with the instep 50 (see FIG. 9) of the foot on which the shoe 10 is to be put. The intermediate portions 36 and 37 have an inner edge 43 or 44, respectively, which is curved to fit the shape of the instep of the foot when the foot is inserted into the shoe 10.

FIG. 5 illustrates an example in which the first shoe tongue piece 17 and the second shoe tongue piece 18 have a shape substantially symmetrical with respect to each other. More precisely, the first shoe tongue piece's contact surface 39 which comes in contact with the instep of the foot has a substantially same area as the second shoe tongue piece's contact surface 40 which comes in contact with the instep of the foot.

Figure 6:
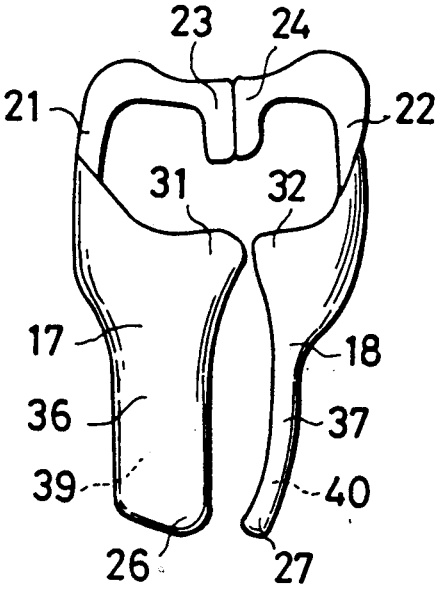
FIG. 6 is an explanatory view of a variant of the first and second shoe tongue pieces of the present invention.
Figure 7:
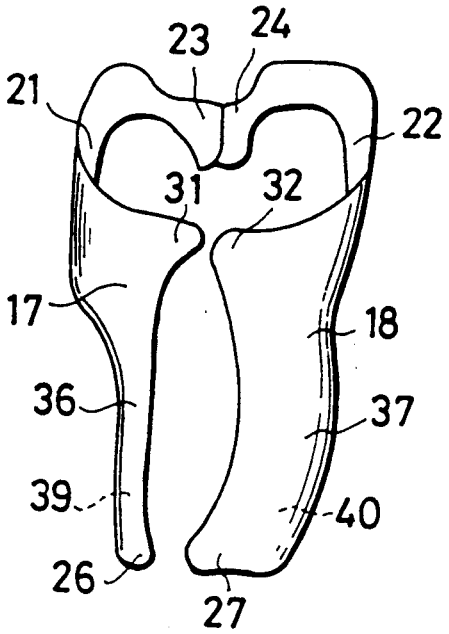
FIG. 7 is an explanatory view of another variant of the first and second shoe tongue pieces of the present invention.

However, the first and second shoe tongue pieces 17 and 18 may have a shape unsymmetrical with respect to each other and different from each other in accordance with various required conditions such as application of the shoes and shape of the foot, as illustrated in FIGS. 6 and 7. FIG. 6 illustrates another example in which the contact surface 39 of the first shoe tongue piece 17 is larger than the contact surface 40 of the second shoe tongue piece 18. Whereas, FIG. 7 illustrates still another example in which the contact surface 40 of the second shoe tongue piece 18 is larger than the contact surface 39 of the first shoe tongue piece 17. The shape and the ratio of the contact surface area of the first and second shoe tongue pieces 17 and 18 are not limited to those of examples illustrated in FIGS. 5 to 7. Any desired shape and ratio of the contact surface area may be selected in accordance with the required conditions as mentioned above.

Each of the first and second shoe tongue pieces 17 and 18 has a soft and elastic structure so as not to excessively tighten and press the foot through the contacting surface 39 or 40 of the shoe tongue piece which is being in contact with the foot when the shoes are put on the feet.

Figure 8:
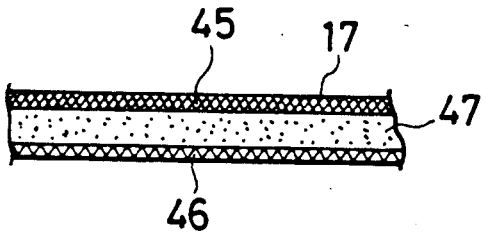
FIG. 8 is a sectional view for explaining the structure of the shoe tongue piece in accordance with the present invention.

An example of the elastic structure of the shoe tongue piece 17 is illustrated in FIG. 8. The shoe tongue piece 17 of FIG. 8 comprises a three-layer structure comprising an upper layer 45 made from for example a woven cloth, a lower layer 46 also made from a woven cloth and an elastic layer 47 sandwiched between the upper and lower layers 45 and 46.

The upper layer 45 preferably comprises leather, nylon or polyester.

The lower layer 46 preferably comprises nylon tricot.

The elastic layer 47 preferably comprises urethane sponge.

Figure 9:
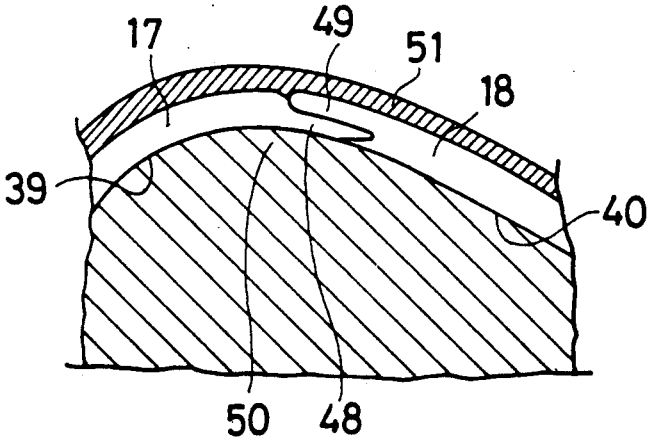
FIG. 9 is a sectional view for explaining a state of deformation of the first and second shoe tongue pieces when overlapped each other when the shoe is put on a foot.

FIG. 9 represents a state in which the first and second shoe tongue pieces 17 and 18 are overlapped each other when the ankle is thin or the instep of the foot is short. An edge 48 of the first shoe tongue piece 17 overlaps an edge 49 of the second shoe tongue piece 18 on the instep 50 of the foot. The overlapped edges 48 and 49 are pressed and deform due to the elastic structure of the shoe tongue piece when a tightening means such as a lace 51 is tightened to fit the shoe to the foot. Therefore, an uncomfortable step is not formed along the overlapped edges of the shoe tongue pieces on the instep of the foot so that it becomes possible to comfortably fit the shoe to the foot.

The embodiments mentioned above with reference to the drawings refer only to shoes for right foot but of course shoes for left foot have the same structure.

Many widely different embodiments of the present invention may be constructed without departing from the spirit and scope of the present invention. It should be understood that the present invention is not limited to the specific embodiments described in the specification, except as defined in the appended claims.

What is claimed is:

1. An athletic shoe comprising:

a sole;

an upper body disposed on said sole and having a throat opening for insertion of a foot;

said upper body including a vamp portion having a U-shaped forward opening elongated from said throat opening and defined by a pair of opposed side rims and a bottom rim; and first and second tongue pieces which collectively cover said U-shaped forward opening from said bottom rim to said throat opening, wherein (i) said first shoe tongue piece is secured to said vamp portion and is disposed along one of said pair of opposed side rims for covering a part of said U-shaped forward opening; and (ii) said second shoe tongue piece is secured to said vamp portion and is disposed along another one of said pair of opposed side rims for covering a remaining part of said U-shaped forward opening.

2. An athletic shoe according to claim 1, wherein said first shoe tongue piece and said second shoe tongue piece are overlapped partially with each other.

3. An athletic shoe according to claim 1, wherein said first shoe tongue piece comprises a first strip portion at one end thereof disposed along about a half of an inner edge of said throat opening so as to wrap about a half of an ankle of the foot and said second shoe tongue piece comprises a second strip portion at one end thereof disposed along about the other half of the inner edge of said throat opening so as to wrap about the other half of the ankle of the foot.

4. An athletic shoe according to claim 3, wherein said first strip portion and said second strip portion are connected together at a free end thereof.

5. An athletic shoe according to claim 1, wherein each of said first and second shoe tongue pieces is comprised of an elastic structure which is soft enough to prevent the shoe tongue piece from applying an excessive pressure to the foot when the shoe is worn.

6. An athletic shoe according to claim 5, wherein said elastic structure of said first and second shoe tongue pieces is a three-layer structure comprising an upper layer, a lower layer and an elastic layer sandwiched between said upper and lower layers.

7. An athletic shoe according to claim 6, wherein said upper layer is made from leather, said lower layer is made from nylon tricot and said elastic layer is made from urethane sponge.

8. An athletic shoe according to claim 6, wherein said upper layer is made from nylon, said lower layer is made from nylon tricot and said elastic layer is made from urethane sponge.

9. An athletic shoe according to claim 6, wherein said upper layer is made from polyester, said lower layer is made from nylon tricot and said elastic layer is made from urethane sponge.

10. An athletic shoe according to claim 1, wherein said first and second shoe tongue prices have an approximately symmetrical shape with respect to each other in a portion around said U-shaped forward opening.

11. An athletic shoe according to claim 1, wherein said first and second shoe tongue pieces have a shape unsymmetrical with respect to each other and different from each other in a portion around said U-shaped forward opening.

12. An athletic shoe according to claim 1, wherein one portion of each said first and second shoe tongue piece is secured to said vamp portion near said bottom rim of said U-shaped forward opening.

13. An athletic shoe according to claim 1, wherein a portion of each said first and second shoe tongue piece is secured to said vamp portion near said throat opening.

14. An athletic shoe according to claim 12 or 13, wherein each said first and second shoe tongue piece includes an intermediate portion which is unsecured to said vamp portion.

15. An athletic shoe comprising:

a sole;

an upper body disposed on said sole and having a throat opening for insertion of a foot;

said upper body including a vamp portion having a U-shaped forward opening elongated from said throat opening and defined by a pair of opposed side rims and a bottom rim; and first and second tongue pieces which collectively cover said U-shaped forward opening from said bottom rim to said throat opening, wherein (i) said first shoe tongue piece is secured to said vamp portion and is disposed along one of said pair of opposed side rims for covering a part of said U-shaped forward opening; and (ii) said second shoe tongue piece is secured to said vamp portion and is disposed along another one of said pair of opposed side rims for covering a remaining part of said U-shaped forward opening, and wherein one portion of each of said first and second shoe tongue pieces is secured to said vamp portion near said bottom rim of said U-shaped forward opening, and another portion of each of said first and second shoe tongue pieces is secured to said vamp portion near said throat opening.

16. An athletic shoe as in claim 15, wherein each said first and second shoe tongue piece includes an intermediate portion which is unsecured to said vamp portion between said one and another secured portions.

17. An athletic shoe as in claim 15 or 16, wherein said first and second shoe tongue portions are joined to one another at a rear end portion thereof.

18. An athletic shoe as in claim 15, wherein each said first and second shoe tongue piece includes a center portion which is secured to said vamp portion along a boundary region between said throat opening and said U-shaped forward opening.

19. An athletic shoe comprising:

a sole;

an upper body disposed on said sole and having a throat opening for insertion of a foot;

said upper body including a vamp portion having a U-shaped forward opening elongated from said throat opening and defined by a pair of opposed side rims and a bottom rim; and first and second tongue pieces which collectively cover said U-shaped forward opening from said bottom rim to said throat opening, wherein (i) said first shoe tongue piece is secured to said vamp portion and is disposed along one of said pair of opposed side rims for covering a pair of said U-shaped forward opening; and (ii) said second shoe tongue piece is secured to said vamp portion and is disposed along another one of said pair of opposed side rims for covering a remaining part of said U-shaped forward opening; and wherein each said first and second shoe tongue piece includes one and another portions which are secured to said vamp portion, and an intermediate portion disposed between said one and another portions which is unsecured to said vamp portion.

* * * * *